US005533576A

United States Patent [19]

Mears

[11] Patent Number: 5,533,576

[45] Date of Patent: Jul. 9, 1996

[54] AUTOMATIC ON-OFF FIRE PROTECTION SPRINKLER

[75] Inventor: James W. Mears, Warwick, R.I.

[73] Assignee: Grinnell Corporation, Cranston, R.I.

[21] Appl. No.: 283,784

[22] Filed: Aug. 1, 1994

[51] Int. Cl.[6] ..... A62C 35/68

[52] U.S. Cl. ..... 169/90; 169/38

[58] Field of Search ..... 169/37, 90, 38, 169/39, 40, 41

[56] References Cited

U.S. PATENT DOCUMENTS

| | | | |
|---|---|---|---|
| Re. 29,155 | 3/1977 | Mears et al. | 169/37 |
| 615,262 | 12/1898 | Dinsmore | 169/37 |
| 2,230,179 | 1/1941 | Cid | 169/37 |
| 3,698,483 | 10/1972 | Martin et al. | 169/19 |
| 3,702,160 | 11/1972 | Grenier | 169/20 |
| 3,757,866 | 9/1973 | Mears et al. | 169/37 |
| 3,812,914 | 5/1974 | Mears | 169/20 |
| 3,835,931 | 9/1974 | Livingston | 169/70 |
| 3,848,676 | 11/1974 | Doherty, Jr. | 169/37 |
| 3,872,928 | 3/1975 | Livingston | 169/56 |
| 3,911,940 | 10/1975 | Johnson | 137/79 |
| 4,258,795 | 3/1981 | Hansen | 169/90 |
| 4,368,782 | 1/1983 | Bray | 169/90 |
| 4,553,602 | 11/1985 | Pieczykolan | 169/19 |

FOREIGN PATENT DOCUMENTS

| | | | |
|---|---|---|---|
| 55295 | 5/1977 | Japan | 169/90 |
| 58297 | 5/1977 | Japan | 169/90 |
| 65998 | 5/1977 | Japan | 169/90 |
| 35297 | 4/1978 | Japan | 169/90 |

*Primary Examiner*—Gary C. Hoge
*Attorney, Agent, or Firm*—Fish & Richardson

[57] ABSTRACT

A fire protection sprinkler is coupled to a pressurized fire extinguishing fluid supply line and positioned generally above a predetermined area to be protected against damage by fire. The sprinkler has a body with an inlet and at least one outlet, a divider defining bias and outlet chambers within the body, and a pilot valve assembly, forming an integral part of the body, is in communication with the bias chamber. The divider has a first "off" position substantially preventing fluid from exiting the outlet chamber and a second "on" position allowing fluid flow from the outlet chamber to be distributed over the area being protected. The pilot valve assembly includes a thermally responsive sensing element, e.g. a bimetal snap disc, disposed in a relatively horizontal plane generally below a main portion of the body for exposure to heat from all regions of the predetermined area to be protected by the sprinkler device.

10 Claims, 4 Drawing Sheets

AUTOMATIC ON-OFF FIRE PROTECTION SPRINKLER

BACKGROUND OF THE INVENTION

The invention relates to automatic sprinklers and more particularly to automatic sprinklers having an on-off function.

Automatic on-off sprinklers, examples of which can be found in U.S. Pat. Nos. Re. 29,155; 3,757,866; 4,553,602; 4,368,782 and 3,848,676, activate automatically in response to a sensed temperature threshold and de-activate when the temperature lowers to a second threshold, e.g as the fire is suppressed. A typical automatic on-off sprinkler, e.g. as shown in FIG. 1, has a fire retardant fluid inlet passage 13, an outlet passage 14 and a passage 32. When an increase in the surrounding temperature causes bimetal disc 126 to reach an "on" threshold, the bimetal disc responds by snapping over to a reverse shape and opening the flow path from chamber 40 to passage 32. Flow of fluid through passage 32 lowers the pressure in chamber 40 and the corresponding side of piston 42, and the piston, in response to the differential pressure acting at opposite sides, moves inward to chamber 40 to allow flow between inlet passage 13 and outlet passage 14.

When the surrounding temperature drops, causing the temperature of the bimetal disc 126 to be lowered to its "off" threshold, the bimetal disc snaps back to its original shape, thereby closing passage 32. As a result, pressure in chamber 40 and on the corresponding side of piston 42 increases to return the piston to its original position, shutting off the flow between inlet passage 13 and outlet passage 14.

If the fire should re-establish itself, a subsequent increase in the surrounding temperature sufficient to raise the temperature of bimetal disc 126 to its "on" threshold causes the bimetal disc to again snap over to a reverse shape and open the flow path from chamber 40 to passage 32. As described above, flow of fluid through passage 32 lowers the pressure on the corresponding side of piston 42, and the piston, in response to differential pressure acting at opposite sides, moves to allow flow of fire extinguishing fluid between inlet 13 and outlet 14.

SUMMARY OF THE INVENTION

According to the invention, a fire protection sprinkler device for a fire protection system adapted to be coupled to a pressurized fire extinguishing fluid supply line and positioned generally above a predetermined area to be protected against damage by fire comprises a sprinkler body having an inlet portion and at least one outlet portion, the inlet portion adapted for coupling to the fluid supply line, a divider element defining a bias chamber and an outlet chamber within the sprinkler body, the divider element having a first "off" position preventing fluid from exiting the outlet chamber and a second "on" position allowing fluid flow from the outlet chamber to be distributed over the predetermined area to be protected, and a pilot valve assembly forming a part of the body and in communication with the bias chamber, the pilot valve assembly including a thermally responsive sensing element disposed in a position generally below a main portion of the body for exposure to heat from all regions of the predetermined area to be protected by the fire sprinkler device.

Preferred embodiments of the invention may include one or more of the following additional features. The sensing element has a first characteristic response to a first level of sustained ambient temperature and a second characteristic response to a second level of sustained ambient temperature, and the sensing element, at the first level of sustained ambient temperature, has a closed or "off" position in which the bias chamber is pressurized and the divider element is in the first position, and the sensing element, at the second level of sustained ambient temperature, has an open or "on" position in which the pressure of the bias chamber is reduced e.g., to a nil value (i.e. ambient pressure), to cause the divider element to move to the second position. The sprinkler body has a primary outlet portion and a secondary outlet portion and the sprinkler body defines a main fluid flow passageway between the inlet portion and the primary outlet portion, and the pilot valve assembly forms an integral part of the secondary outlet portion and includes at least one outlet passage, the pilot valve adapted for movement between an open position and a closed position to control flow of fluid in a secondary fluid flow passageway from the bias chamber to the secondary outlet portion and through the outlet passage, and the sensing element, in the closed or "off" position, prevents fluid flow through the secondary passageway and, in the open or "on" position, allows fluid flow through the secondary passageway. The sensing element comprises a bimetal snap disc having a specifically selected thermal response characteristic. In preferred embodiments, the bimetal snap disc is positioned below a main portion of the body of the sprinkler in a substantially horizontal orientation, thereby to enhance transfer of heat from the surrounding area to the sensing element. Preferably, the fire protection sprinkler device further comprises a bulb-type thermally responsive element mounted adjacent to the primary outlet portion and partially contained within a frame, the frame acting in combination with a primary seal to normally block the primary outlet, and a deflector mounted to the frame to distribute fluid flow over the area to be protected. The divider element, e.g. a piston, includes a main biasing spring for biasing the divider element towards the first or "off" position and a secondary seal for substantially reducing fluid flow through the primary outlet portion, in the absence of the primary seal, the divider element defining a region of restricted clearance relative to the body of the sprinkler device, the region of restricted clearance permitting the inlet portion and the secondary outlet to be in fluid communication, a tubular strainer located primarily within the inlet portion preventing unacceptably large debris from entering the region of restricted clearance and the pilot valve assembly. The pilot valve assembly includes a valve biasing spring for biasing the pilot valve towards the closed or "off" position. The bulb-type thermally responsive element is adapted to operate at a third level of sustained ambient temperature which is intermediate between the first and second levels of sustained ambient temperature, thereby clearing the primary outlet, and the bimetal snap disc being adapted to move from the closed "off" position toward the open "on" position at a second level of sustained ambient temperature relatively greater than the third level of sustained ambient temperature, thereby to allow water to flow through the secondary outlet passageway resulting in a decrease in pressure in the bias chamber, the resulting differential pressure between the outlet chamber and the bias chamber causing the divider element to move from the first "off" position toward the second "on" position, allowing fluid to flow out through the primary outlet passageway. The bimetal snap disc is adapted, when the sustained ambient temperature lowers to the first level of sustained ambient temperature, to move from the open position toward the closed position to close the pilot valve and prevent flow through the secondary passageway, thereby resulting in an increase in pressure in the bias chamber to cause the divider element to move from the second position toward the first position to substantially inhibit fluid flow through the primary outlet passageway.

The invention thus provides an automatic on-off fire sprinkler device with a pilot valve sensor that is not significantly shielded, e.g. by the sprinkler body, from the transfer of heat from any location within the area intended to be protected by the sprinkler.

These and other features and advantages of the invention will be apparent from the following description of a presently preferred embodiment, and from the claims.

DESCRIPTION OF THE PREFERRED EMBODIMENT

Figure 2:
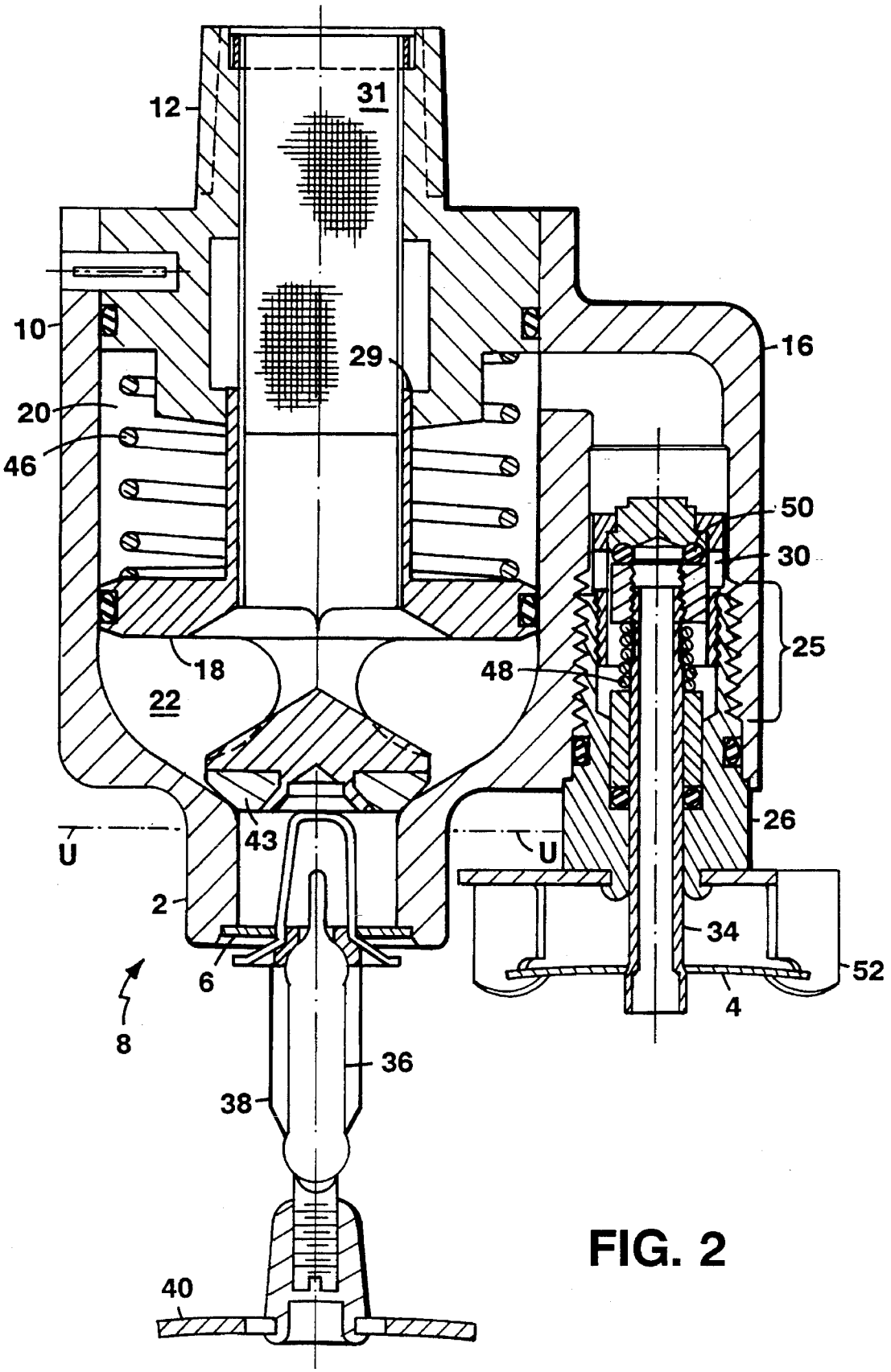
FIG. 2 is a front sectional view of an automatic on-off fire protection sprinkler of the present invention, with the sprinkler shown in the "off" position.

Referring to FIG. 2, an automatic on-off fire protection sprinkler 8 of the present invention has body 10 defining an inlet portion 12, a primary outlet portion 2 and a secondary outlet portion 16. Inlet portion 12 connects to a pressurized fluid supply line (not shown). Contained within body 10 is a piston 18 which divides body 10 into a bias chamber 20 and an outlet chamber 22. Body 10 defines a main fluid flow passageway (arrow 24, FIG. 3) between inlet portion 12 and primary outlet portion 2.

Attached to secondary outlet portion 16 (e.g., by screw threads 25) is a normally closed pilot valve assembly 26 including outlet passages 30. Pilot valve assembly 26 defines a secondary fluid flow passageway (arrow 28, FIG. 3) from the water passageway defined by the inlet portion 12 through a restricted circumferential clearance 29 into bias chamber 20 and through secondary outlet portion 16 and outlet passages 30. A tubular strainer 31 positioned within the water passageway defined by the inlet portion 12 prevents unacceptably large debris from flowing into the restricted clearance 29 and the pilot valve assembly 26.

Pilot valve assembly 26 includes sensing element 4, e.g., a bimetal snap disc, which exhibits a characteristic hysteresis response to input, e.g., a snap action change in curvature between two positions dependent on a sustained ambient temperature of the surrounding environment. Sensing element 4 is positioned to extend below a plane, U, at the underside of body 10 such that it is not screened by the body 10 from the heat from a fire within the predetermined area, A (FIG. 4), to be protected by the sprinkler 8. The movement of sensing element 4 actuates a tubular stem 34. Tubular stem 34 resides in one of two positions according to the position of sensing element 4. In one position, i.e. the closed or "off" position, seal 50 prevents fluid flow through secondary passageway 28, and, in the other position, i.e. the open or "on" position, fluid flow through secondary passageway 28 occurs. When fluid is not permitted to flow through secondary passageway 28, main fluid flow passageway 24 is closed off; and fluid flow through secondary passageway 28 causes main passageway 24 to open (as described below).

A bulb-type thermally responsive element 36 is mounted to body 10 downstream of primary outlet portion 2. Bulb-type thermally responsive element 36 is contained within a frame 38 and a deflector 40 is attached to frame 38. A primary seal 6 (a TEFLON® (PTFE) coated spring plate) normally prevents fluid leakage from the primary outlet portion 2, e.g., as long as the sustained ambient temperature surrounding the sprinkler remains below a third level at which the bulb-type thermally responsive element 36 operates. Following operation of element 36 there may be some slight leakage past fluid secondary seal 43.

A spring 46 aids in biasing piston 18 toward a downward, sealing position. In pilot valve assembly 26, a biasing spring 48 urges tubular stem 34 into sealing contact with a seal 50. Bracket 52 supports sensing element 4 at selected points about its periphery and maintains the periphery of the disc in a relatively fixed position.

Figure 3:
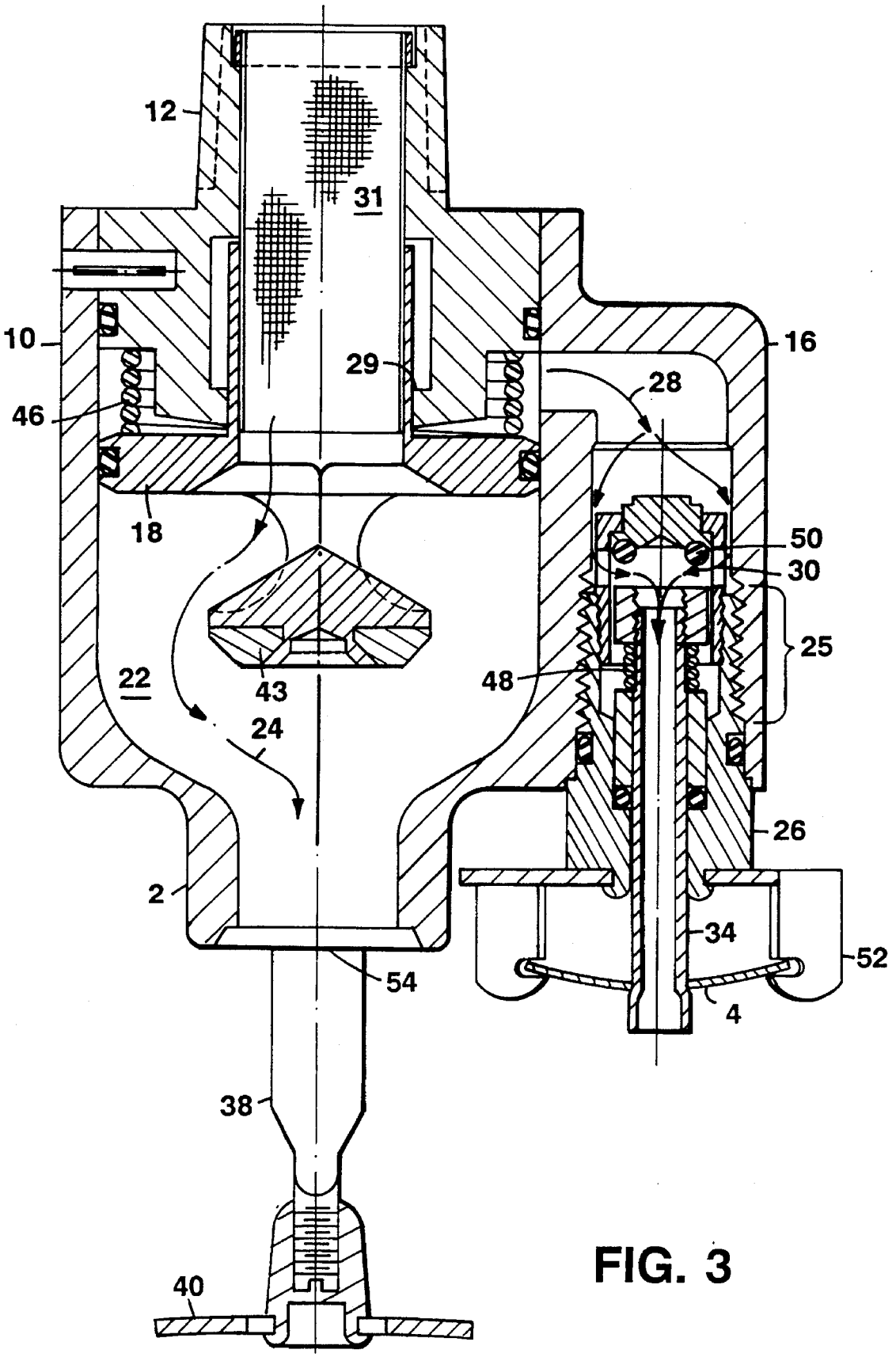
FIG. 3 is a similar view of the automatic on-off fire protection sprinkler of FIG. 2, with the sprinkler shown in the "on" position.

In operation, bulb 36 bursts when the ambient temperature surrounding the sprinkler reaches a sustained value at a third level, i.e. intermediate of the first level and the second level, e.g., 140° F., releasing primary seal 6 and opening passage 54 (see FIG. 3). When the ambient temperature reaches a sustained value of the second level, e.g., 165° F., sensing element 4 snaps to a reverse curvature configuration to actuate tubular stem 34, thereby opening secondary passageway 28.

Figure 4:
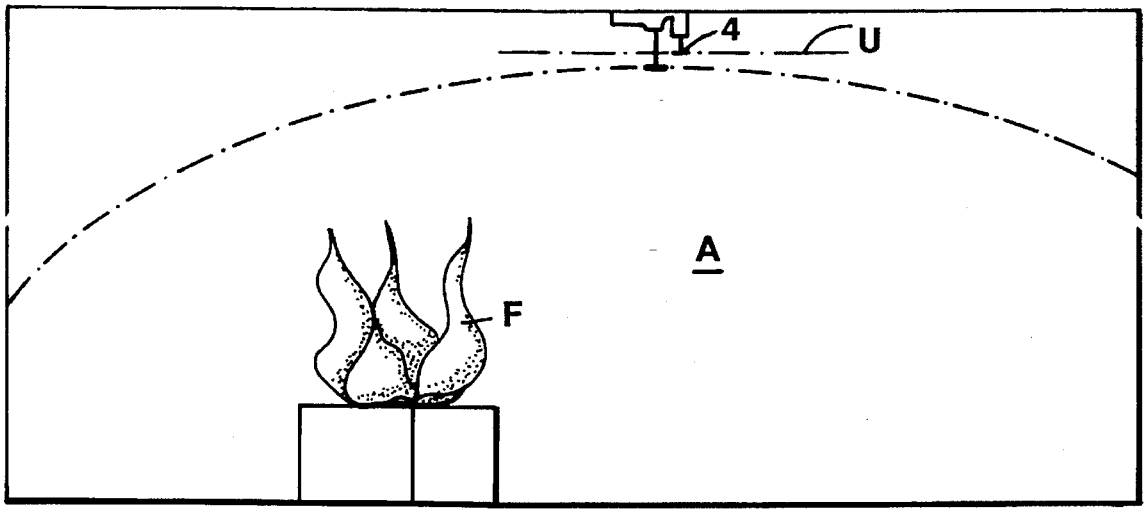
FIG. 4 is a somewhat diagrammatic view of the automatic on-off fire protection sprinkler of FIG. 2 showing the pilot valve sensor disposed in a position exposed to heat from a fire within the predetermined area to be protected by the sprinkler.

As illustrated in FIGS. 2–4, the sensing element 4 is positioned in a region below the underside of body 10 so that it is not screened by body 10, e.g. from the heat from a fire, F (FIG. 4), in the predetermined area, A, intended to be protected by the sprinkler. As a result, the sensing element 4 can respond reliably, and without excessive delay, to changes in the temperature of the surrounding environment.

Figure 1:
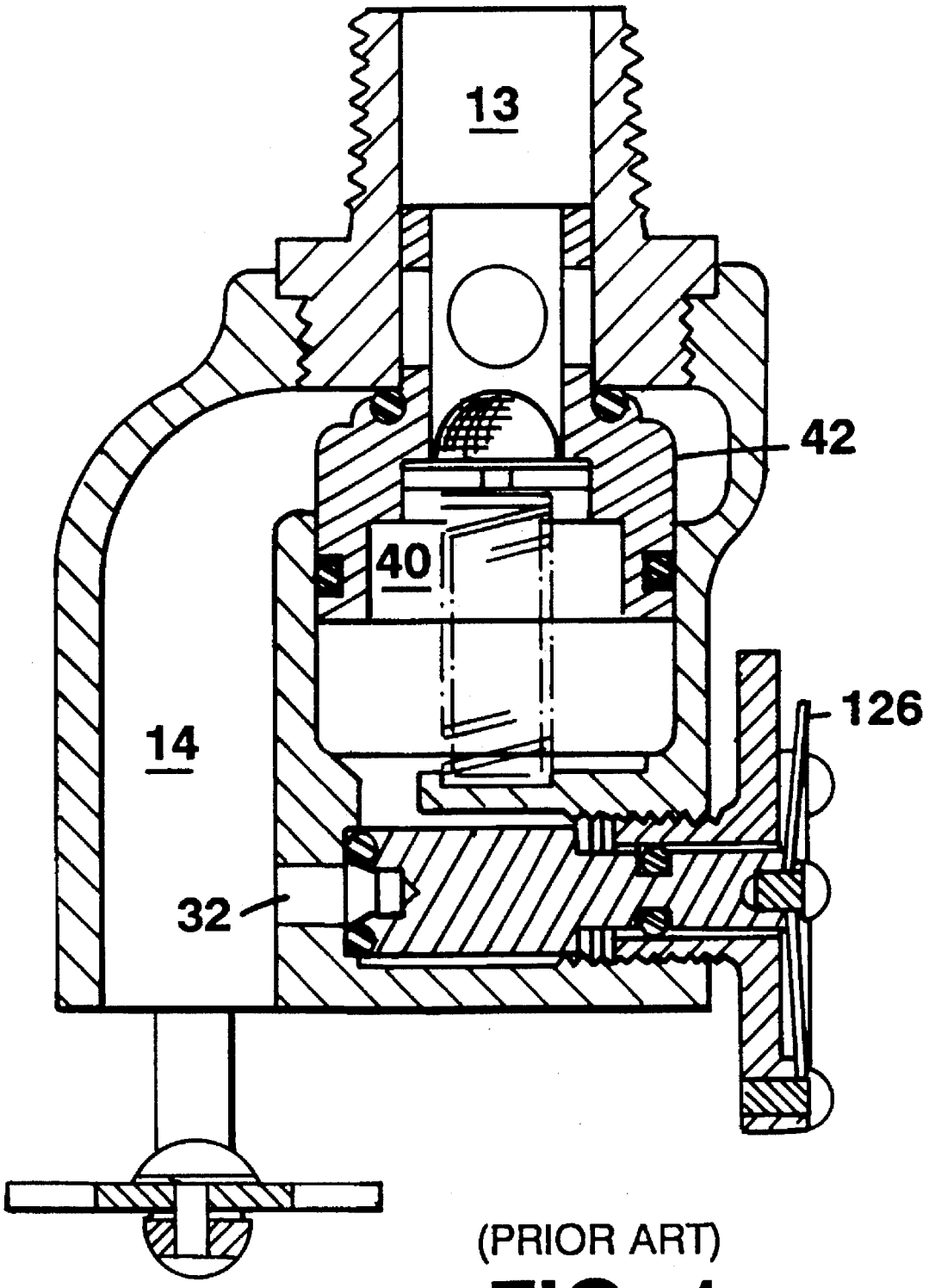
(PRIOR ART) FIG. 1
FIG. 1 is a front sectional view of a typical prior art automatic on, off fire protection sprinkler.
Figure 5:
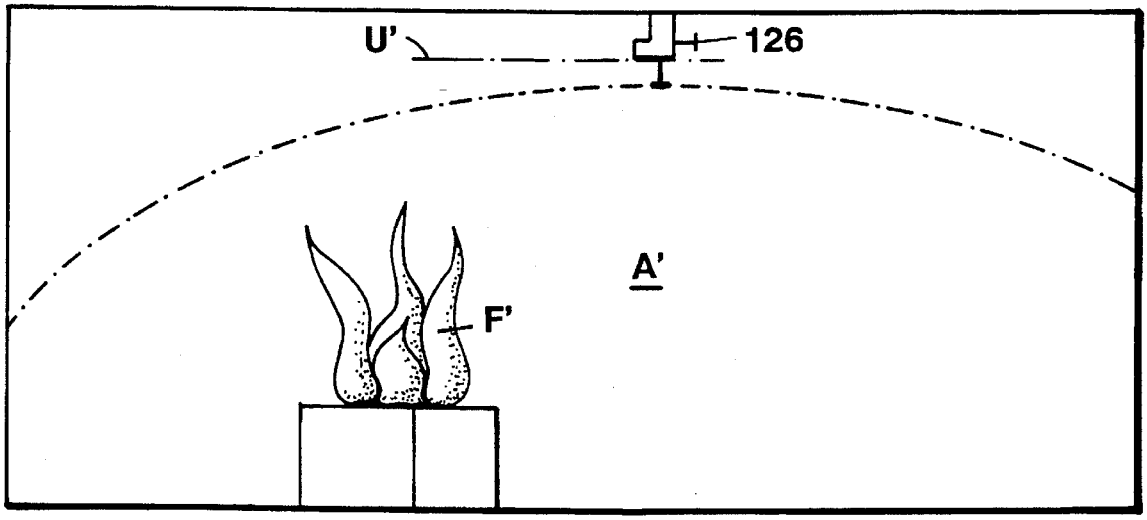
(PRIOR ART) FIG. 5
FIG. 5 is a similar view of a typical prior art automatic on-off fire protection sprinkler with the pilot valve sensor disposed in a position at least partially shielded from the heat from a fire within the predetermined area to be protected by the sprinkler.

In contrast, in prior art systems, e.g. as shown in FIGS. 1 and 5, the sensor 126 is substantially vertically oriented and located primarily in a region above a plane, U' (FIG. 5), of the underside of the sprinkler body. As a result, the sensor for the pilot valve may be at least partially screened from a portion of the surrounding environment by the body of the device, e.g. from the heat from a fire, F' (FIG. 5), within the predetermined area, A' intended to be protected by the sprinkler. This can adversely affect the dynamics of the rise and fall of the temperature of the sensor and thus delay the response of the sensor to changes in the temperature of the surrounding environment.

Referring again to FIG. 3, with sensing element 4 in its reverse configuration, fluid flows out of outlet passages 30 depleting fluid in bias chamber 20 faster than it fills through restricted clearance 29. As the pressure drops in bias chamber 20, the differential in pressure on the two, opposite sides of piston 18 causes piston 18 to move towards the inlet portion, releasing secondary seal 43, e.g., made of PTFE or similar material. Fluid is then free to flow through primary passageway 24 and against deflector 40 where it is distributed over the predetermined area, A, protected by the sprinkler.

When the water spray has suppressed the fire such that the sustained ambient temperature surrounding the sprinkler is reduced to the lower threshold of the first level, e.g., 100° F., sensing element 4 returns to its original position actuating tubular stem 34 to close secondary passageway 28. The pressure then increases within bias chamber 20 as fluid flows through restricted clearance 29, forcing central piston 18 to move downward to close secondary seal 43 and cut off fluid flow through primary passageway 24. The on-off cycles of the sprinkler will continue as long as ambient temperature conditions dictate, e.g., with re-establishment and suppression of the fire.

The sprinkler of the present invention can be mounted in a ceiling such that most of the body is hidden above the ceiling without losing speed of thermal response.

These and other embodiments of the invention are within the following claims. For example, the bracket which supports the periphery of the sensing element and/or the tubular stem which is actuated by operation of the sensing element disc may be thermally insulated from the sensing element, e.g., the bimetal snap disc, to further enhance the speed of operation of the on-off sprinkler device.

What is claimed is:

1. A fire protection sprinkler device for a fire protection system adapted to be coupled to a pressurized fire extinguishing fluid supply line and positioned generally above a predetermined area to be protected against damage by fire, said sprinkler device comprising:

a sprinkler body having an inlet portion adapted for coupling to the fluid supply line, a primary outlet portion and a secondary outlet portion, said sprinkler body defines a main fluid flow passageway between said inlet portion and said primary outlet portion, a divider element within said sprinkler body defining a bias chamber in communication with said secondary outlet portion and an outlet chamber in communication with said primary outlet portion, said divider element having a first "off" position preventing fluid from exiting said outlet chamber and a second "on" position allowing fluid flow from said outlet chamber to be distributed over the predetermined area to be protected, a pilot valve assembly forming an integral part of said secondary outlet portion and including at least one outlet passage, said pilot valve assembly adapted for movement between an open position and a closed position to control flow of fluid in a secondary fluid flow passageway from said bias chamber to said secondary outlet portion and through said outlet passage, said pilot valve assembly including a thermally responsive bimetal snap disc having a selected thermal responsive characteristic and disposed in a position generally below a main portion of said body for exposure to heat from all regions of the predetermined area to be protected by said sprinkler device, said snap disc, in moving to an "off" position, moves said pilot valve assembly to said closed position and thereby prevents fluid flow through said secondary passageway and, in moving to an "on" position, moves said pilot valve assembly to said open position and thereby allows fluid flow through said secondary passageway, a thermally responsive element mounted adjacent to said primary outlet portion and acting in combination with a primary seal to normally block said primary outlet, and said divider element includes a main biasing spring for biasing said divider element toward said first position and a secondary seal for substantially reducing fluid flow through said primary outlet portion in the absence of said primary seal, said divider element defining a region of restricted clearance relative to the body of the sprinkler device, said region of restricted clearance permitting said inlet portion and said secondary outlet to be in fluid communication when said pilot valve assembly is in said open position.

2. The fire protection sprinkler device of claim 1, wherein said snap disc has a first characteristic response to a first level of sustained ambient temperature and a second characteristic response to a second level of sustained ambient temperature, and said snap disc, at said first level of sustained ambient temperature, being in said "off" position thereof in which said bias chamber is pressurized and said divider element is in said first position, and said snap disc, at said second level of sustained ambient temperature, being in said "on" position thereof in which pressure of said bias chamber is reduced to cause said divider element to move to said second position.

3. The fire protection sprinkler device of claim 1, wherein said bimetal snap disc is positioned in a substantially horizontal plane disposed generally below said main portion of said sprinkler body, thereby to enhance transfer of heat from a predetermined area to be protected against damage by fire.

4. The fire protection sprinkler device of claim 1, further comprising a frame, said frame acting in combination with said primary seal to normally block said primary outlet, and a deflector mounted to said frame to distribute fluid over the area to be protected.

5. The fire protection sprinkler device of claim 1, further comprising a tubular strainer located primarily within said inlet portion to prevent unacceptably large debris from entering said region of restricted clearance and said pilot valve assembly.

6. The fire protection sprinkler device of claim 1, wherein said divider element is a piston.

7. The fire protection sprinkler device of claim 1, wherein said pilot valve assembly includes a valve biasing spring for biasing said pilot valve toward said closed position.

8. A fire protection sprinkler device for a fire protection system adapted to be coupled to a pressurized fire extinguishing fluid supply line and positioned generally above a predetermined area to be protected against damage by fire, said sprinkler device comprising:

a sprinkler body having an inlet portion adapted for coupling to the fluid supply line, a primary outlet portion and a secondary outlet portion, said sprinkler body defines a main fluid flow passageway between said inlet portion and said primary outlet portion, a divider element within said sprinkler body defining a bias chamber in communication with said secondary outlet portion and an outlet chamber in communication with said primary outlet portion, said divider element having a first "off" position preventing fluid from exiting said outlet chamber and a second "on" position allowing fluid flow from said outlet chamber to be distributed over the predetermined area to be protected, a pilot valve assembly forming an integral part of said secondary outlet portion and including at least one outlet passage, said pilot valve assembly adapted for movement between an open position and a closed position to control flow of fluid in a secondary fluid flow passageway from said bias chamber to said secondary outlet portion and through said outlet passage, said pilot valve assembly including a thermally responsive bimetal snap disc for moving said pilot valve assembly between said open position and said closed position, said snap disc being disposed in a position generally below a main portion of said body for exposure to heat from all regions of the predetermined area to be protected by said sprinkler device, said bimetal snap disc has a first characteristic response to a first level of sustained ambient temperature and a second characteristic response to a second level of sustained ambient temperature, said bimetal snap disc, at said first level of sustained ambient temperature, has an "off" position in which said pilot valve assembly is closed, said bias chamber is pressurized, and said divider element is in said first position, and said bimetal snap disc, at said second level of sustained ambient temperature, has an "on" position in which said pilot valve assembly is open and pressure of said bias chamber is reduced to cause said divider element to move to said second position, said bimetal snap disc, in moving to said "off" position thereof, moves said pilot valve assembly to said closed position to prevent fluid flow through said secondary passageway and, in moving to said "on" position thereof, moves said pilot valve assembly to said open position to allow fluid flow through said secondary passageway, a thermally responsive element mounted adjacent to said primary outlet portion and acting in combination with a primary seal to normally block said primary outlet, said thermally responsive element being adapted to operate at a third level of sustained ambient temperature which is intermediate between said first and second levels of sustained ambient temperature, thereby opening said primary outlet, and said bimetal snap disc being adapted to move from said "off" position thereof toward said "on" position thereof at said second level of sustained ambient temperature relatively greater than said third level of sustained ambient temperature, thereby to allow water to flow through said secondary outlet passageway resulting in a decrease in pressure in said bias chamber, the resulting differential pressure between said outlet chamber and said bias chamber causing said divider element to move from said first "off" position toward said second "on" position, allowing fluid to flow out through said primary outlet passageway.

9. The fire protection sprinkler device of claim 8, wherein said bimetal snap disc is adapted, when the sustained ambient temperature lowers to said first level of sustained ambient temperature, to move from said "on" position thereof toward said "off" position thereof to close said pilot valve and prevent flow through said secondary passageway, thereby resulting in an increase in pressure in said bias chamber to cause said divider element to move from said second position toward said first position to substantially inhibit fluid flow through said primary outlet passageway.

10. The fire protection sprinkler device of claim 8, further comprising a frame, said frame acting in combination with said primary seal to normally block said primary outlet, and a deflector mounted to said frame to distribute fluid over the area to be protected.

* * * * *